US005943851A

United States Patent [19]

Matas Gabalda et al.

[11] Patent Number: 5,943,851

[45] Date of Patent: Aug. 31, 1999

[54] YARN TENSIONING DEVICE AND TEXTILE MACHINE EQUIPPED THEREWITH

[75] Inventors: Carlos Matas Gabalda, Granges les Valence; Bernard Puaux, Chassieu, both of France

[73] Assignee: ICBT Valence, France

[21] Appl. No.: 09/091,709

[22] PCT Filed: Mar. 6, 1997

[86] PCT No.: PCT/FR97/00395

§ 371 Date: Jun. 18, 1998

§ 102(e) Date: Jun. 18, 1998

[87] PCT Pub. No.: WO97/38932

PCT Pub. Date: Oct. 23, 1997

[30] Foreign Application Priority Data

Apr. 18, 1996 [FR] France ..... 96.05119

[51] Int. Cl.[6] ..... D01H 1/10

[52] U.S. Cl. ..... 57/58.86; 242/147 M; 242/150 M; 242/155 M; 57/58.76

[58] Field of Search ..... 57/58.86, 58.74, 57/58.76, 58.83; 242/147 M, 150 M, 155 M, 419.3, 419.9; 66/146

[56] References Cited

U.S. PATENT DOCUMENTS

| | | | |
|---|---|---|---|
| 3,635,052 | 1/1972 | Monney | 66/146 |
| 3,797,775 | 3/1974 | White | 242/155 M |
| 4,526,329 | 7/1985 | Takeda | 242/155 M |
| 4,557,431 | 12/1985 | Zitzen | 242/150 R |
| 4,709,543 | 12/1987 | Lorenz | 57/58.86 |
| 5,294,071 | 3/1994 | Hartel et al. | 242/150 M |
| 5,782,424 | 7/1998 | Horvath et al. | 242/150 M |
| 5,791,584 | 8/1998 | Kuroiwa | 242/155 M |

FOREIGN PATENT DOCUMENTS

| | | |
|---|---|---|
| 1187713 | 9/1959 | France . |
| 2145056 | 2/1973 | France . |
| 2167957 | 8/1973 | France . |
| 2664622 | 7/1990 | France . |
| 2016263 | 4/1969 | Germany . |
| 2819703 | 11/1979 | Germany . |

*Primary Examiner*—William Stryjewski
*Assistant Examiner*—Gina Silverio
*Attorney, Agent, or Firm*—Wall Marjama Bilinski & Burr

[57] ABSTRACT

A yarn tensioning unit for use in a textile machine that includes a shaft having a pulley mounted for rotation thereon over which yarn is conducted. A pneumatic cylinder is slidably mounted on the shaft which contains a piston that is affixed to the shaft to form an expandable chamber with one end wall of the cylinder. The opposite end wall of the housing is magnetically coupled to the pulley to establish a magnetic brake for the pulley. The spacing between the cylinder end wall and the pulley is adjusted by controlling the flow of fluid into and out of the expandable chamber to vary the magnetic braking force exerted upon the pulley.

8 Claims, 4 Drawing Sheets

YARN TENSIONING DEVICE AND TEXTILE MACHINE EQUIPPED THEREWITH

BACKGROUND OF THE INVENTION

The present invention relates to a new type of yarn tension device capable of being used on any type of textile apparatus and, more particularly, on the machines making it possible for yarns of any type to be twisted and/or combined by twisting.

In the course of the various conversion operations which a yarn undergoes during its production, it is essential to impart as uniform and as constant a tension as possible to it. Many solutions for tension devices have been proposed hitherto for this purpose, the simplest involving simply tensioning the yarn on guide elements consisting, for example, of two disks laid one against the other and subjected to the action of a spring.

Since these solutions do not make it possible to control accurately the tension which is imparted, various proposals have been made for solving these problems.

Thus, as mentioned in the preamble of FR-A-2,145,056, it has been proposed to use tension devices which comprise, on the one hand, a pulley, the periphery of which has a friction layer and is in contact with the yarn over at least some of its circumference, and, on the other hand, means for braking said pulley. These pulley braking means consist of an eddy current brake taking the form of a motor of the asynchronous type, the rotor of which is integral with the shaft of the pulley and the stator windings of which are fed by an adjustable direct current source. Such a type of tension device which, in general terms, corresponds to the device which is the subject of U.S. Pat. No. 3,797,775, is not satisfactory, particularly in that it requires a supply of electric current and in that it is therefore necessary to have as many supply connections as there are tension devices.

The abovementioned FR-A-2,145,056 aims to overcome this disadvantage, the braking device which it describes consisting of an electric generator, the rotor of which is integral with the shaft of the pulley and the armature of which is connected to a charging resistor, the magnetic field of the generator being supplied by a permanent magnet.

The solution described in this document also allows the possibility of simultaneously ensuring the adjustment of the tension imparted by a plurality of tension devices. It has, however, the disadvantages of being costly and, above all, demanding very high accuracy in its construction.

FR-A-2,167,957 describes a solution in which braking for guiding the yarn is obtained by producing a magnet having an even number of magnetic poles, this magnet being arranged opposite a disk, the face of which is pierced with a plurality of holes and which supports the yarn guide pulley. The pulley is braked by varying the distance between the disk and the magnet.

This last solution, although making it possible to avoid the problem of electric connections, in no way makes it possible to consider simultaneously controlling all the tension devices which a textile machine having a multiplicity of identical workstations arranged side by side may comprise.

SUMMARY OF THE INVENTION

Now a new type of tension device has been found, this being the subject of the present invention, said tension device overcoming the disadvantages of the prior solutions and not only making it possible to avoid a supply of electric current, but also ensuring progressive tensioning during the starting of the machine, said tension remaining constant under normal operating conditions. Moreover, all or some of the tension devices, which the machine may comprise when it consists of a plurality of identical workstations, can be adjusted simultaneously on all the feeders which perform the same function. Finally, the device according to the invention makes it possible to obtain a very wide range in the tensions capable of being imparted to the yarn and can be used for yarns which may have very different characteristics from one another.

In the rest of the description, the invention will be described with regard to a tension device which is used on a stranding machine and in which the tension imparting element, which will be designated in the rest of the description by the expression "pulley", consists of two dishes mounted on a hub and locked one against the other by means of a nut making it possible to adjust the pressure between the dishes and therefore to drive the yarn positively. It is clear that any other equivalent device could be used, for example it would be possible to produce a tension device according to the invention by causing the yarn to pass against the periphery of a drum or of a simple grooved pulley.

In general terms, the yarn tension device according to the invention is of the type comprising:

- a pulley mounted freely rotatably at the end of a shaft carried by a housing, the yarn being in contact against the surface of said pulley;
- means for braking said pulley which consist of concentrically arranged permanent magnets locked in terms of rotation relative to the shaft and arranged opposite a ring made of ferromagnetic material and mounted on the bearing supporting the pulley;
- means making it possible to vary the spacing between the magnets and the pulley-carrying bearing by sliding one of these elements on the shaft.

The device according to the invention is defined in that the means for adjusting the spacing between the magnets and the pulley to be braked consist of:

- a first assembly exerting a thrust tending to bring the support of the magnets nearer to the ring associated with the pulley, to a predetermined minimum value;
- a second assembly exerting a counterthrust of adjustable value, tending to move the magnets away from the surface of the ring, said counterthrust means consisting of a compressed-air source acting on the face of a piston which is mounted fixedly on the shaft so as to bear against a bearing surface of the latter and the other face of which is subjected to the action of the first thrust means, compressed air being supplied simultaneously to all the tension devices which the machine comprises by means of a common pneumatic line.

The variation in the spacing between the magnets and the ring associated with the pulley making it possible to adjust the tension imparted to the yarn by the tension device may, according to the invention, be obtained either by displacing said magnets longitudinally on the shaft carrying the pulley, said shaft in that case being mounted fixedly on the frame of the machine, or by displacing the shaft supporting said pulley, fastening to the frame of the machine in that case being carried out by means of the housing supporting the magnets.

BRIEF DESCRIPTION OF THE DRAWINGS

However, the invention and the advantages which it affords will be understood better from the exemplary embodiment given below and illustrated by the accompanying diagrams in which:

FIG. 1 illustrates diagrammatically a side view of a workstation of a textile machine, known as a "direct strander", making it possible to combine two elementary yarns by false twisting.

DESCRIPTION OF THE INVENTION

Figure 1:
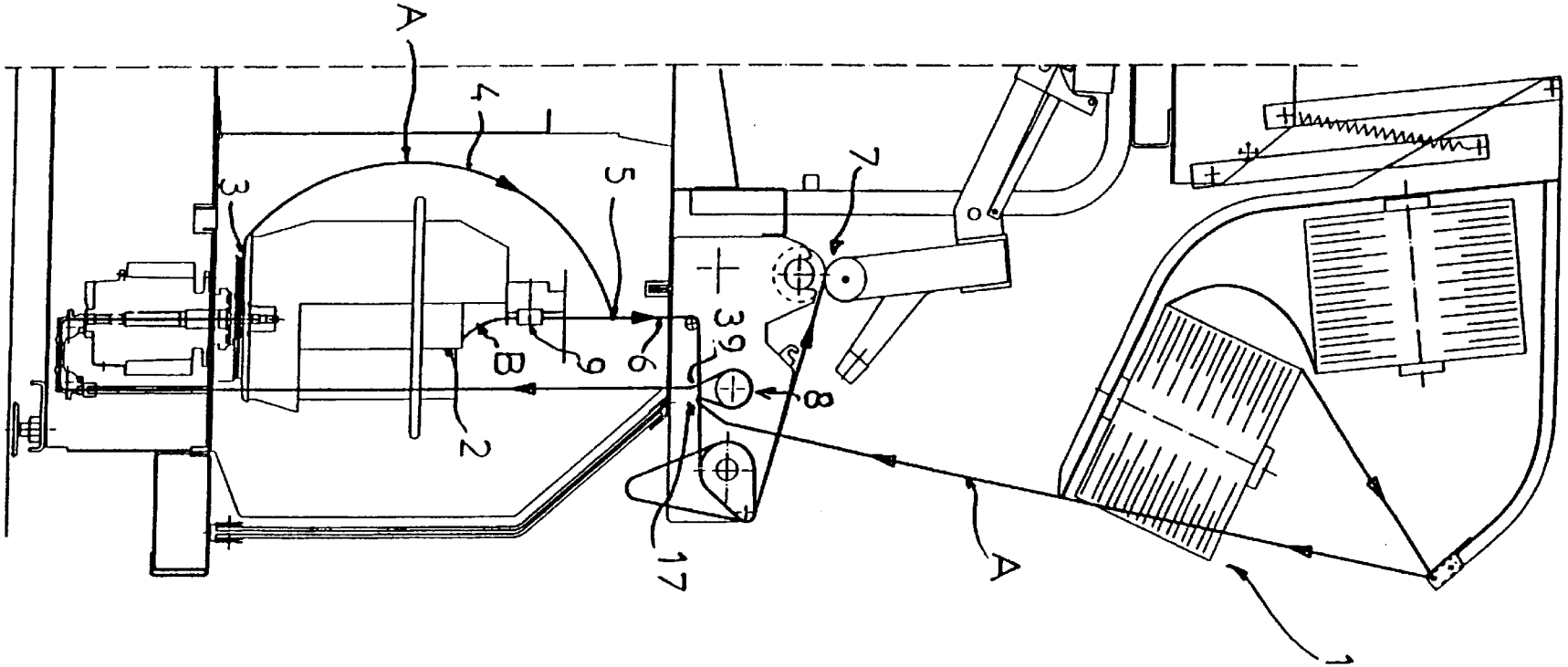
FIG. 1 is a general view of a textile machine making it possible to carry out the stranding of two elementary yarns equipped with a tension device according to the invention.

In such a type of machine, which has been known for a very long time (see U.S. Pat. No. 3,026,063), each workstation thus makes it possible to join two elementary yarns (A, B) by twisting, said yarns coming from two supply sources (1, 2). The yarn (A) coming from the bobbin (1) passes through a turntable (3) or the like, so as to form a balloon (4), within which the supply source (2) for the yarn (B) is arranged. The two yarns (A) and (B) are combined by being twisted at the joining point (5), and then the strand (6) formed is wound conventionally, for example on a winding system (7) which does not impart any additional twist. The takeup of the two yarns (A) and (B) forming the strand (6) is determined by the winding speed at (7). In order to equalize the tensions so as to have a balanced assembly, tension systems (8, 9) are provided for each of the yarns (A, B). The tension device (8) makes it possible to adjust the reserve length of the yarn (A) around the table (3) and performs the function of a shock absorber which absorbs the jolts occurring during the unwinding of the bobbin (1), thus making it possible to maintain a highly uniform balloon (4).

The tension device according to the invention is particularly suitable to be used for imparting tension to the yarn (A) which passes within the turntable (3) and forms the balloon (4).

The strander equipped with tension devices (8) according to the invention therefore consists of a plurality of identical workstations arranged side by side, and the tension devices (8) making it possible to ensure the tension of the yarn (A) coming from the support (20) carried by a creel which, in the present case, is arranged on the upper part of the machine, are mounted individually on a support plate (35) carried by said frame. The positioning of these tension devices is advantageously located on the frame of the machine in the region of the winding system and in front of the latter, the yarn (B) being delivered directly to the brake (9) located upstream of the stranding point (6) in the extension of the axis of the supply source (2) of the yarn (B).

Figure 2:
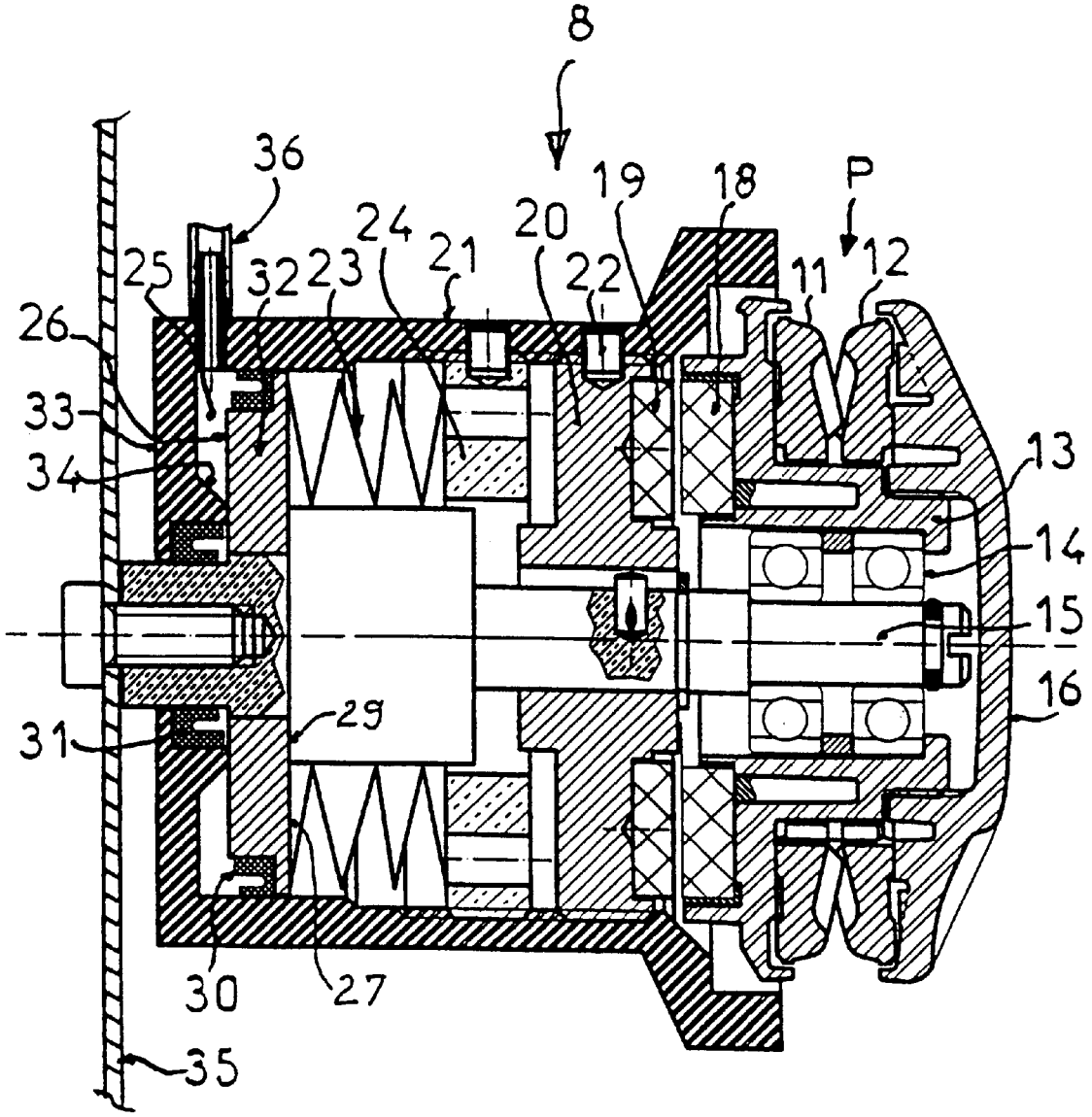
FIG. 2 is a detailed view, in longitudinal section, of a tension device produced according to the invention.
Figure 3:
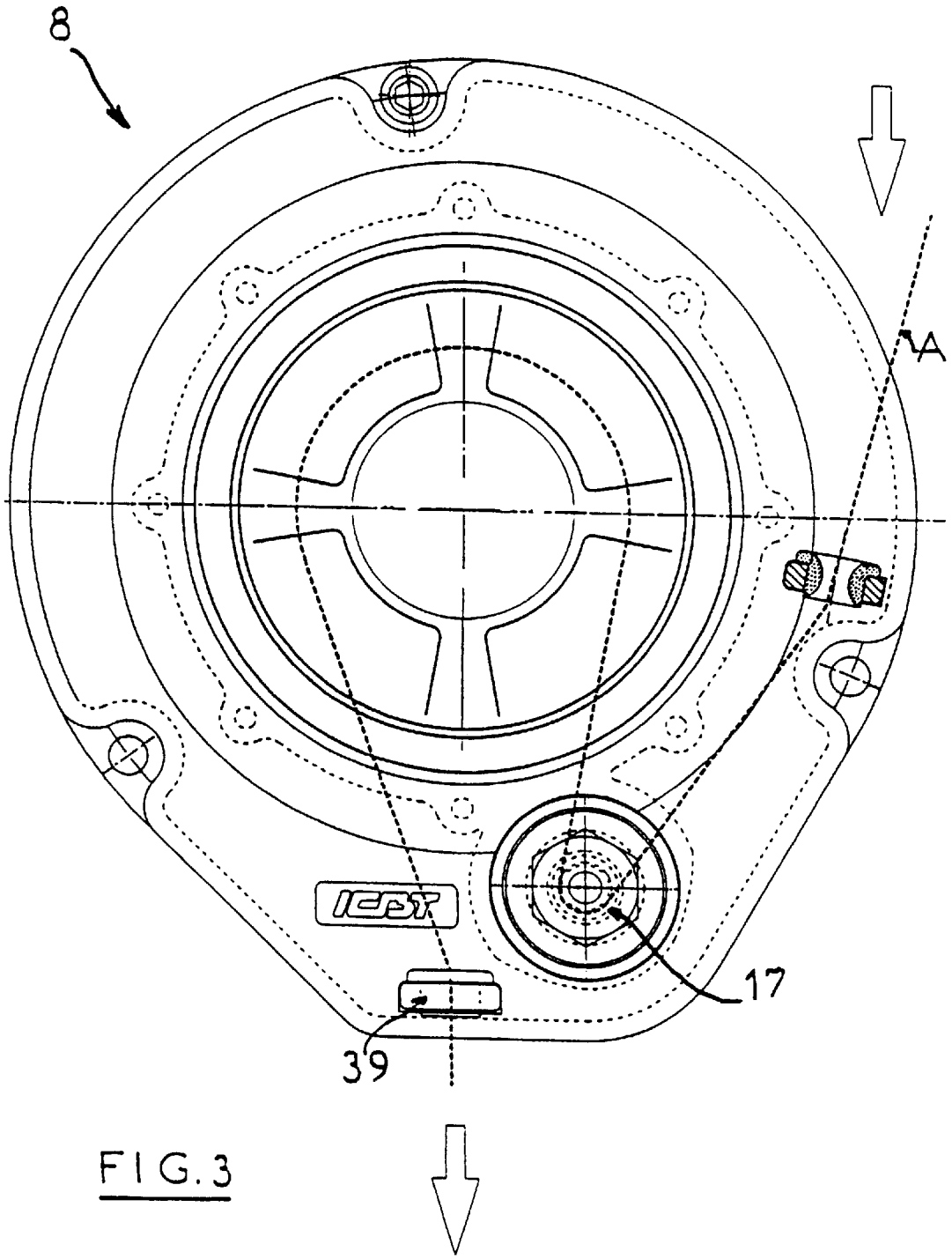
FIG. 3 is a front view of such a tension device, showing how the passage of the yarn around the "pulley" making it possible to impart the tension takes place.

As emerges from FIGS. 2 and 3, in the embodiment illustrated substantially to the scale 1, the tension device (8) according to the invention comprises, as an element making it possible to impart tension to the yarn, a pulley consisting of two dishes (11, 12), between which the yarn (A) passes, these dishes being mounted on a hub (13) which is itself mounted freely rotatably by means of rolling bearings (14) at the end of a shaft (15). Said dishes (11, 12) are locked on the hub by means of an assembly in the form of a nut (16), thus making it possible to adjust the pressure of the dishes one against the other and consequently the tension which they impart to the yarn. The yarn (A) passes through the space contained between the two dishes and is maintained in the region of their zone of interpenetration, the enveloping of the yarn around said dishes being determined by two guides (17, 39) (illustrated in FIG. 3 only) which are arranged respectively upstream and downstream of the bearing plane.

As emerges from FIG. 2, the hub (13) supporting the pulley comprises, on its face opposite said pulleys, a ring (18) made from a ferromagnetic material based, for example, on ferrite.

The means making it possible to ensure the braking of the pulley consist of a plurality of permanent magnets (19), of which there are two in the present case and which take the form of pellets having a diameter of 15 mm. These magnets are mounted concentrically to the shaft (15) on a support (20) which is itself immobilized inside a housing (21). The support (20) is locked by means of screws (22) and is immobilized in terms of rotation relative to the shaft (15), but, by contrast, is free in terms of translational movement relative to the latter.

According to the invention, the tension device comprises means making it possible to vary the spacing between the magnets (19) and the ring (18) carried by the pulley, this variation being between a minimum value of 1 mm, thus making it possible to avoid any risk of interference attributable to geometrical faults, and a maximum spacing which depends on the power of the magnets and which, in the present case, is 4 mm.

These means making it possible to ensure adjustment comprise, first of all, a first thrust assembly which tends to bring the support (20) of the magnets (19) nearer to the ring. This displacement is limited by a predetermined minimum value and, in the present case, is obtained by means of an assembly in the form of a spring (23) which is arranged around the shaft (15) and which bears, on the one hand, on a fixed annular bearing (24) integral with the housing (21) and, on the other hand, on the rear face of a piston (32) integral with the shaft (15), thus allowing the housing (21) to slide relative to the assembly (32–15).

As emerges from FIG. 2, the housing (21) is designed so as to have a shoulder (34) on its rear face (33), thus making it possible to produce a chamber (25) between the bottom of the housing and the face (26) of the piston, the other face of the piston bearing against a shoulder provided on the shaft (15). Seals (30) and (31) are provided for ensuring the leaktightness of the chamber (25). The inlet (36) of a compressed air supply opens out inside this chamber (25). The shaft (15) is mounted fixedly on a support plate (35) integral with the frame of the machine.

By virtue of such a design, it is therefore possible to be able to adjust the tension imparted by the pulley during the passage of the yarn. In the illustration shown in FIG. 2, the various elements of the tension device are illustrated in their position, in which the magnets (19) are at a predetermined minimum distance, namely, in the present case, of the order of one millimeter, from the ring (18) mounted on the hub (13) in the pulley (P). This position makes it possible to obtain maximum tension on the yarn. When the tension value is to be modified, compressed air is supplied to the chamber (25), thus tending to push back the piston (32) which exerts a counterthrust on the spring (23) and therefore tends to displace the housing (21) carrying the magnets relative to the shaft (15), in the direction toward the left, as seen in FIG. 2, thus making it possible to increase the spacing between said magnets and the ring (18). The braking carried out by means of the magnets consequently tends to decrease.

Figure 4:
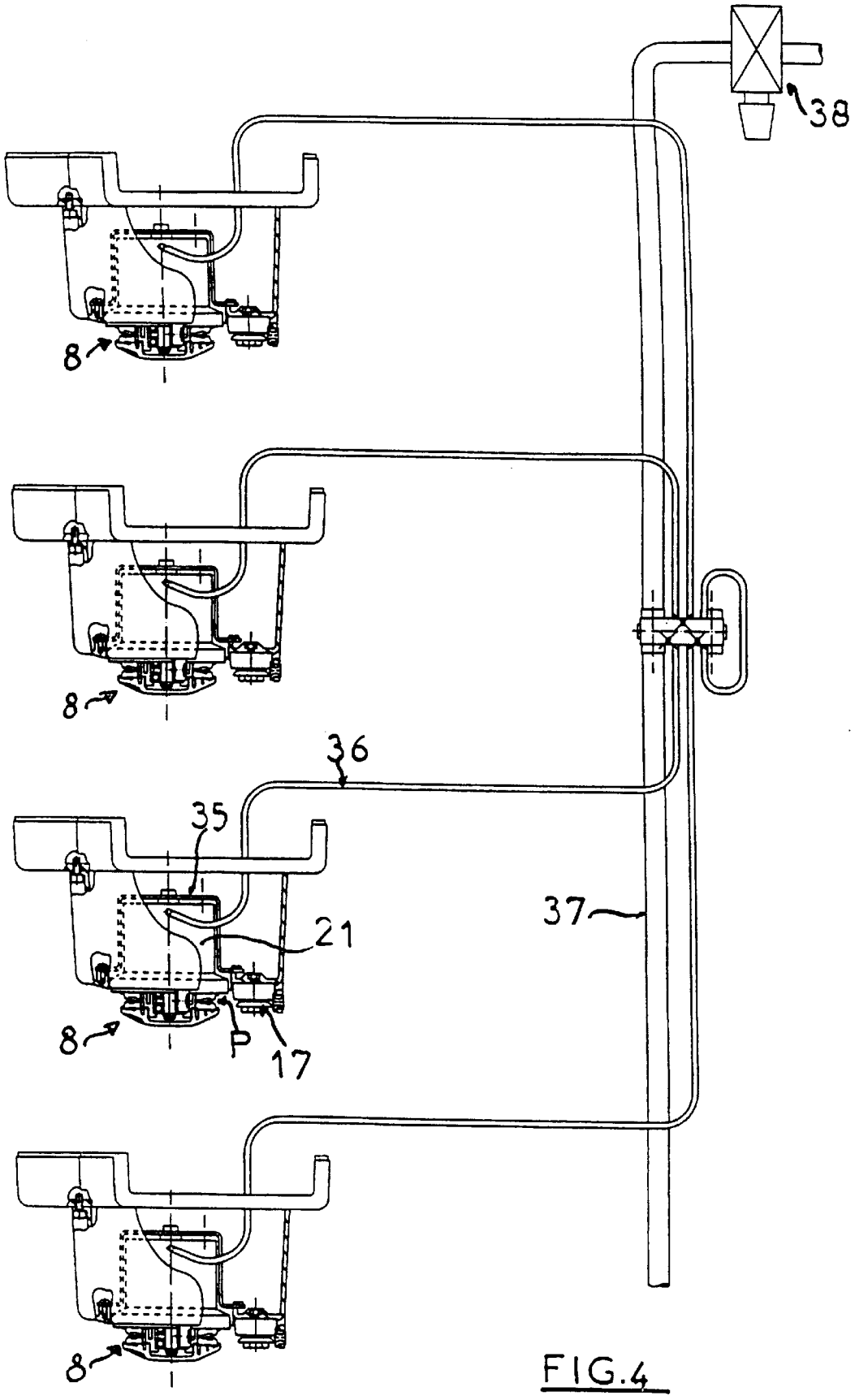
FIG. 4 illustrates a top view of a plurality of tension devices for equipping four stations of a textile machine and connected to a common compressed-air supply source.

As emerges from FIG. 4, it is possible, by virtue of such a design, to supply a plurality of tension devices from a single compressed-air supply source (37), the injection of air being adjusted by means of a central pneumatic valve (38), and each tension system (8) being connected to said supply source by means of a pipe (36).

In the example described, the displacement of the magnets relative to the pulley is obtained by displacing the housing supporting the magnets on the shaft which is held fixedly on the machine. The converse procedure would be conceivable, that is to say mounting the housing fixedly on the machine, thus then causing the pulley to be displaced relative to said housing.

Of course, the invention is not limited to the exemplary embodiment described above, but embraces all its variants produced in the same spirit.

We claim:

1. Apparatus for tensioning yarn as the yarn moves through a work station of a textile machine, said apparatus including a shaft having a pulley mounted for rotation thereon over which yarn is conducted, a housing slidably mounted upon said shaft for axial movement toward and away from said pulley, magnetic braking means for magnetically coupling said pulley to said housing so that a maximum braking force is exerted upon the pulley when the housing is in a first home position and a minimum braking force is exerted upon the pulley when the housing is moved axially away from said pulley to a second position, pneumatic means for producing relative axial movement between the housing and the pulley to increase and decrease the braking force exerted upon said pulley.

2. The apparatus of claim 1 wherein said housing further includes a cylinder slidably mounted upon said shaft and a piston mounted inside said cylinder that is secured to said shaft to provide an expandable chamber between the piston and one end wall of the cylinder, and said pneumatic means further includes means for introducing a fluid into said cylinder to provide a force acting between the cylinder and said piston.

3. The apparatus of claim 2 that further includes a biasing means acting between said piston and said cylinder for urging said housing into said home position.

4. The apparatus of claim 3 wherein said magnetic means includes at least one magnetic piece mounted in the cylinder and at least one ferromagnetic piece mounted in the pulley.

5. The apparatus of claim 4 wherein the pulley is rotatably supported upon said shaft by bearing means located at the distal end of the shaft and the proximal end of the shaft is secured in a support structure.

6. The apparatus of claim 4 wherein said magnetic means includes a plurality of circumferentially spaced apart magnetic pieces mounted in a second end wall of said cylinder circumferentially spaced and a plurality of ferromagnetic pieces mounted in said pulley.

7. In a textile machine containing a plurality of work stations for treating yarn, each work station containing apparatus for tensioning yarn as it moves therethrough that includes:

a shaft having a pulley mounted for rotation on said shaft over which yarn is conducted, a pneumatic cylinder slidably mounted upon said shaft that contains a piston that is secured to said shaft so that an expandable chamber is established between the piston and one end wall of the cylinder, braking means for magnetically coupling the cylinder to said pulley so that a maximum braking force is exerted upon said pulley when the cylinder is in a first position adjacent the pulley and a minimum braking force is extended upon the pulley when the cylinder is in a second position further away from the pulley, and pneumatic means for controlling the flow of fluid into and out of the expandable chambers of each tensioning unit so that tensioning units in the work stations are adjusted simultaneously.

8. The machine of claim 7 that further includes biasing means acting between the piston and one end wall of the cylinder for urging the cylinder into said first position.

* * * * *